United States Patent [19]

Shaffer et al.

[11] 4,292,528

[45] Sep. 29, 1981

[54] CASK FOR RADIOACTIVE MATERIAL AND METHOD FOR PREVENTING RELEASE OF NEUTRONS FROM RADIOACTIVE MATERIAL

[75] Inventors: Peter T. B. Shaffer, Grand Island; Michael F. Gaffney, Ransomville, both of N.Y.

[73] Assignee: The Carborundum Company, Niagara Falls, N.Y.

[21] Appl. No.: 50,908

[22] Filed: Jun. 21, 1979

[51] Int. Cl.[3] ..... G21F 5/00

[52] U.S. Cl. ..... 250/506; 250/515

[58] Field of Search ..... 250/507, 506

[56] References Cited

U.S. PATENT DOCUMENTS

| | | | |
|---|---|---|---|
| Re. 29,876 | 1/1979 | Reese | 250/506 |
| 3,005,105 | 10/1961 | Lusk | 250/506 |
| 3,119,933 | 1/1964 | Allen | 250/507 |
| 4,096,392 | 6/1978 | Rubinstein et al. | 250/507 |

OTHER PUBLICATIONS

Ceramic Bulletin, vol. 36, No. 3 (1957) p. 109 "Boron Compounds for Nuclear Applications," by Finlay.
Chemical Abstracts, 68-92198.

*Primary Examiner*—Harold A. Dixon
*Attorney, Agent, or Firm*—Raymond F. Kramer; Robert C. Weber

[57] ABSTRACT

A cask for radioactive material, such as nuclear reactor fuel or spent nuclear reactor fuel, includes a plurality of associated walled internal compartments for containing such radioactive material, with neutron absorbing material present to absorb neutrons emitted by the radioactive material, and a plurality of thermally conductive members, such as longitudinal copper or aluminum castings, about the compartment and in thermal contact with the compartment walls and with other such thermally conductive members and having thermal contact surfaces between such members extending, preferably radially, from the compartment walls to external surfaces of the thermally conductive members, which surfaces are preferably in the form of a cylinder. The ends of the shipping cask also preferably include a neutron absorber and a conductive metal covering to dissipate heat released by decay of the radioactive material. A preferred neutron absorber utilized is boron carbide, preferably as plasma sprayed with metal powder or as particles in a matrix of phenolic polymer, and the compartment walls are preferably of stainless steel, copper or other corrosion resistant and heat conductive metal or alloy. The invention also relates to shipping casks, storage casks and other containers for radioactive materials in which a plurality of internal compartments for such material, e.g., nuclear reactor fuel rods, are joined together, preferably in modular construction with surrounding heat conductive metal members, and the modules are joined together to form a major part of a finished shipping cask, which is preferably of cylindrical shape. Also within the invention are methods of safely storing radioactive materials which emit neutrons, while dissipating the heat thereof, and of manufacturing the present shipping casks.

18 Claims, 13 Drawing Figures

CASK FOR RADIOACTIVE MATERIAL AND METHOD FOR PREVENTING RELEASE OF NEUTRONS FROM RADIOACTIVE MATERIAL

This application relates to containers for radioactive materials. More particularly, it relates to containers, such as shipping casks, which include shielding material, such as boron carbide, for absorbing neutrons emitted by radioactive substances, and heat conducting material for conducting away heat generated by such radioactive decay.

The many problems associated with the storage and shipping of radioactive substances have long been recognized. Such materials must be made safe so that harmful radiation is not loosed and so that heat generated during nuclear reaction or radioactive decay is dissipated and radioactive interaction between the stored articles may be minimized or kept below a critical level. Various structures and designs for casks have been suggested for accomplishing these purposes. However, for best transfer of heat from a radioactive source to the exterior of such shipping casks, from which the heat may be removed by the surrounding air, it has been the accepted practice to utilize a one-piece heat conductive metal body. Such a unitary structure is expensive to fabricate, heavy and difficult to install and because of its unitary structure it must be completely replaced if any part of it becomes defective. Also, the neutron absorbing portion of shipping casks, storage racks or other containers or holders for radioactive materials will often be unitarily constructed, sometimes with the poison plates or other neutron absorbers being unremovably incorporated in such structure and at other times with such absorbers being removable but with holding means for them being integral and incapable of ready disassembly.

The present invention provides modular constructions of wall members or segments containing neutron absorbing materials and/or the compartments for containing such materials and/or modular construction of the "body" of heat conductive metal for transferring heat from the radioactive source to the air or other medium for removing such heat from the casks. It also relates to modules or sub-assemblies of such compartments and heat transfer conductors, which may be readily joined together to form a shipping cask or similar container or holder. Use of this invention results in effective and economic neutron absorption and heat transfer by means of a structure which facilitates manufacture assembly, repair, maintenance and trouble-free operation, all at lower costs than required for unitary structures. Such costs are decreased further and assembly and maintenance are facilitated when modular parts of the neutron absorbing structure are identical and therefore, interchangeable and when parts of the heat conductors are also interchangeable.

In accordance with the present invention a cask for radioactive material comprises a walled internal compartment for containing such material, in which a compartment wall member absorbs neutrons emitted by the radioactive material, and a plurality of thermally conductive members about such walled compartment, at least one of which has a thermal contact surface thereof in thermal contact with the compartment wall member and with adjacent such thermally conductive members and which have thermal contact surfaces between such members extending from such a compartment wall member to external surfaces of such thermally conductive members. Preferably, the shipping cask or other container or holder for radioactive material is for one which releases neutrons and comprises an assembly of a plurality of compartments and a plurality of thermally conductive members about the assembly with thermal contact surfaces of such members contacting the outer walls of the assembled compartments and with the conductive members being in contact with each other along thermal contact surfaces between them, which surfaces extend from the outer walls of the assembled compartments to external surfaces of the thermally conductive members which are in contact with a heat removing medium, such as air. Sub-assemblies or modules of such compartments and heat transfer bodies may be joined together to form the casks. Also within the invention are methods of manufacturing the present modules, shipping casks and holder for radioactive material and for decreasing neutron emissions from such material and promoting removal of heat therefrom.

The invention will be readily understood by reference to the present description thereof, taken in conjunction with the drawing, in which:

FIG. 1 is a vertical section along plane 1—1 of FIG. 2 of a normally horizontally positioned cylindrical cask of the present invention, illustrating the modular construction of the walled compartments thereof for containing radioactive material, such as fuel rods, heat conductive body members surrounding such an assembly of compartments and sub-assemblies containing pluralities of such compartments and members, with twelve compartments being illustrated;

Figure 1:
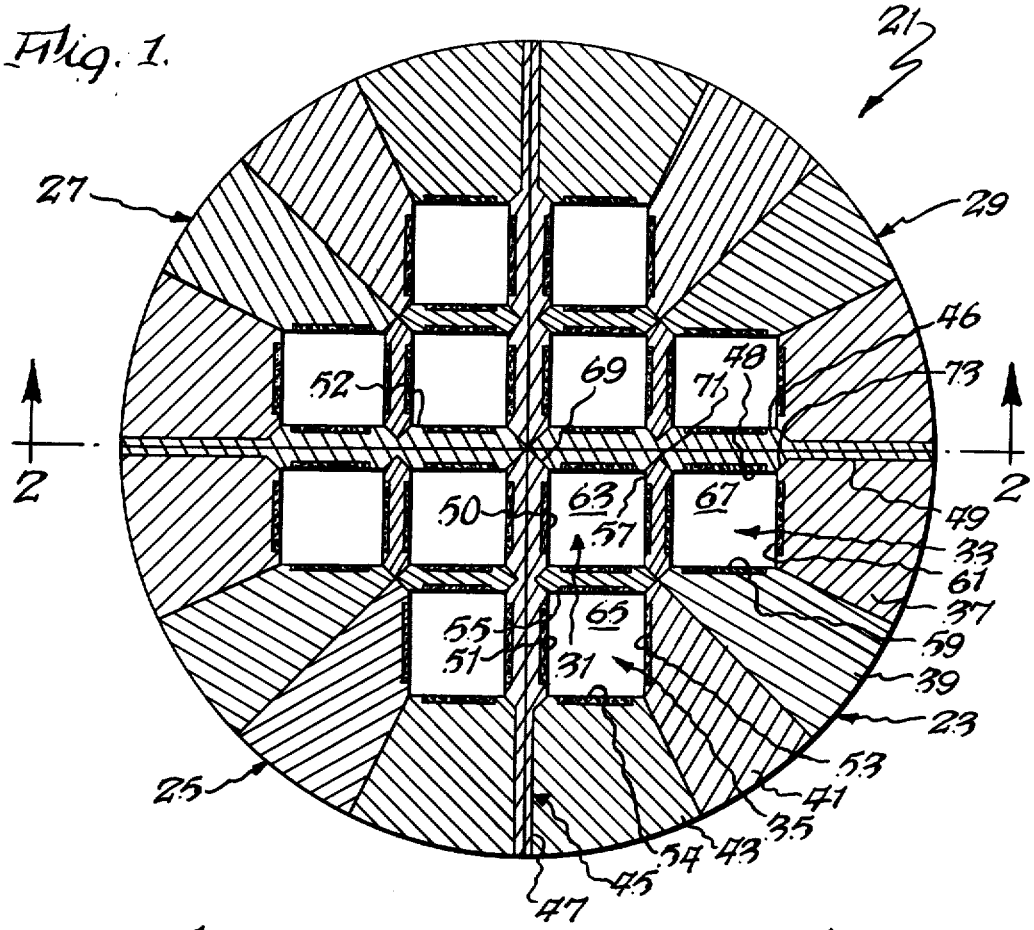

In FIG. 1 shipping cask 21 is shown, comprising four identical quadrant modules 23, 25, 27 and 29. For ease of explanation that module identified by numeral 23 will be discussed in more detail but the references thereto apply also to other modules or sub-assemblies 25, 27 and 29. Module 23 includes a plurality of walled internal compartments 31, 33 and 35, a plurality of thermally conductive members 37, 39, 41 and 43 and a framework 45, with sides 47 and 49. Compartment walls 55 and 57, as illustrated, are identical and interchangeable and may be considered to be modular components useful for construction of the sub-assembly of compartments for the radioactive material. Such compartments may have all walls (usually four) thereof the same (like 55 and 57) or, as shown, may have framing member and conductive member parts serving as wall members and as holders or bearers of neutron absorbing material. In sub-assembly or quadrant 23 there are tubular openings 63, 65 and 67, all of square internal cross-sections. Framing members or sides 47 and 49 are joined together at corner faces 69 and are shaped, as at 71 and 73 to fit, accommodate and hold in place wall 57 and conductor 37 and at corresponding locations to similarly match wall member 55 and conductor 43. Conductor members 39 and 41 are also shaped to form walls of compartments 67 and 65 respectively, while frames 47 and 49 are shaped to form walls of compartments 63 and 65 (left sides) and 63 and 67 (upper sides), respectively.

As illustrated, neutron absorbing material deposits 51, 54 and 53 are in frame 47, conductor 43 and conductor 41, respectively, for compartment 65. Similarly such deposits 48, 61 and 59 are in frame 49 and members 37 and 39 of compartment 67. Another such absorber deposit 50 is in frame 47 for compartment 63.

Fastening together of the wall modules of each of the compartments may be effected by welding, brazing, soldering, cementing (preferably with thermally conductive cement), fusing, mechanical interfitting, or other suitable means and the assembled walls may be readily disassemblable, depending on the means of joinder utilized, or may be permanently held together. Similarly, the framework members may be held to the compartment wall members and thermally conductive members 37, 49, 41 and 43 may be held to each other, to the walls and to the framework.

Inside the various compartment wall members (or appropriate frames or conductors) which, as shown, have external walls or coverings of stainless steel, copper, aluminum, silver or other suitable conductive metal, preferably resistant to corrosion and radiation from the radioactive substance being shipped or stored, may be poison plates or sheets for neutron absorption, such as those described in one or more of U.S. Pat. Nos. 4,225,467; 4,198,322; 4,213,883; 4,156,147; and 4,218,622, and U.S. patent application Ser. No. 960,150, filed Nov. 13, 1978, which include boron carbide (the boron of which includes $B^{10}$) in a matrix of phenolic polymer, with or without glass fiber reinforcement. The construction of such walls is better illustrated in FIGS. 7 and 8 and will be mentioned in additional detail in the description of the embodiment of those figures. Alternatively and often preferably, the wall members (and other such members, if so desired) may be made in accordance with U.S. patent application Ser. No. 13,555 of the present inventors, filed Feb. 21, 1979. In such modification of the invention the poison plates may be present or may be omitted and the wall members may be hollow or solid. The structure of the wall members shown in FIG. 1 is that corresponding to the plasma sprayed (with boron carbide and conductive metal powder) articles of Ser. No. 13,555 of the present inventors, described more fully with respect to FIGS. 5 and 6 herein. Sometimes the wall members may be vented to the atmosphere, especially when gas production due to high level radioactivity may be expected from phenolic polymer or any other components which can be affected by radiation. In the usual situations this is not a problem and accordingly, no vents are illustrated in the present drawing. Of course, various modifications of the compartments, walls, framework and heat transfer members may be made, changing the sizes, shapes, interfittings, connections and materials thereof. However, normally it will be preferred that the heat conducting members should be of copper for best thermal conductivity to carry heat away from the radioactive material. Also, the surfaces of contact between adjacent such members should extend outwardly from intimate heat conducting contact with the compartment walls to the outer walls of the shipping casks and to contact with the ambient air or other heat dissipating medium or means. Preferably, such path is substantially, essentially or exactly radial (highly preferable), extending from the cask axis to the cask circumference and almost always extending a distance equal to or greater than a compartment diameter or side. Of course, the compartment wall members should be metallic or otherwise thermally conductive so as to transmit heat from the radioactive material in the interior of the compartment along such wall members to the heat conductive or heat transfer members about such compartment, preferably without relying to a significant extent on heat transfer through the neutron absorbing medium (except when it is mixed with conductive metal, as in FIGS. 1, 5, 6 and 13).

Figure 2:
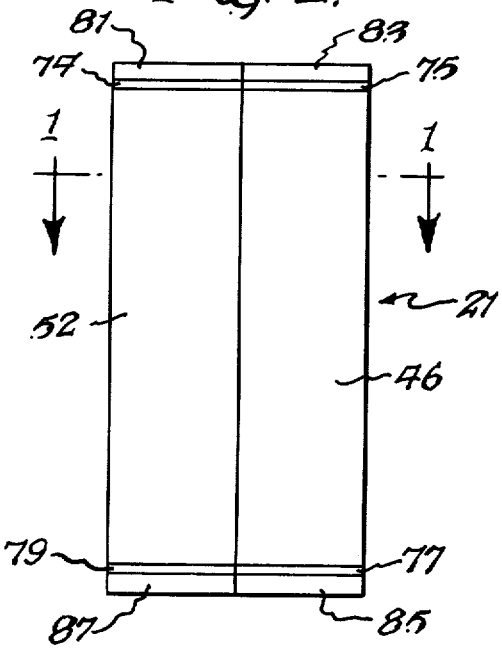
FIG. 2 is a horizontal section taken along plane 2—2 of FIG. 1, shown on a reduced scale.
Figure 3:
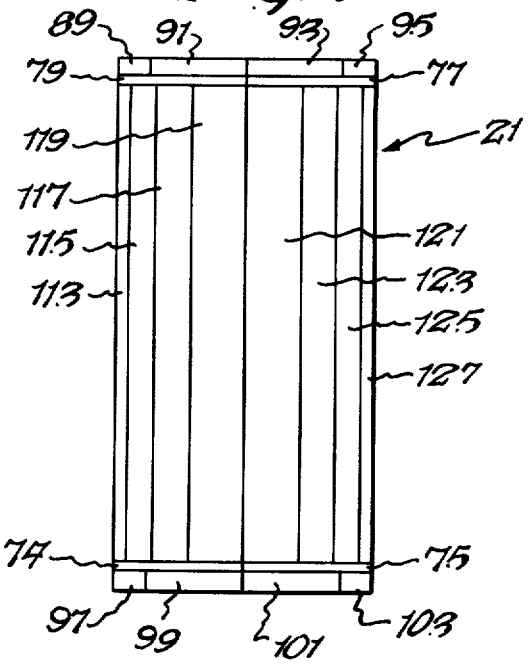
FIG. 3 is a top plan view of the cask of FIGS. 1 and 2.
Figure 4:
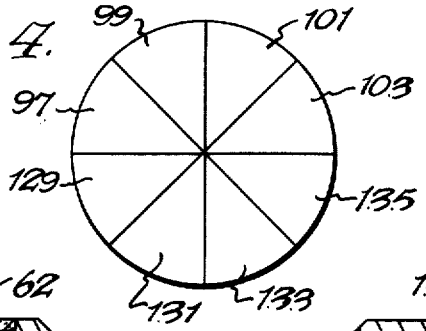
FIG. 4 is an end view thereof.
Figure 5:
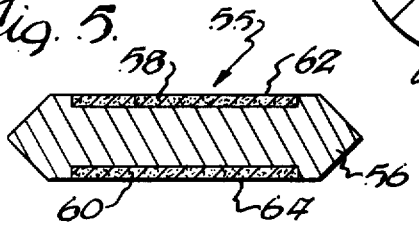
FIG. 5 is a transverse vertical sectional view of a wall member of a compartment of FIGS. 1 and 13.
Figure 7:
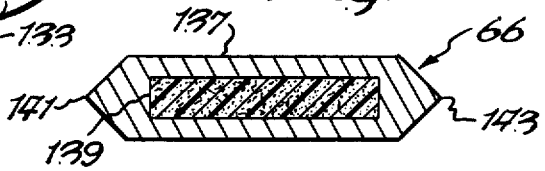
FIG. 7 is a transverse vertical sectional view of a wall member of same external dimensions as that of FIG. 5 but different construction, which may be substituted for that of FIG. 5, as in the casks of FIGS. 1 and 13.
Figure 6:
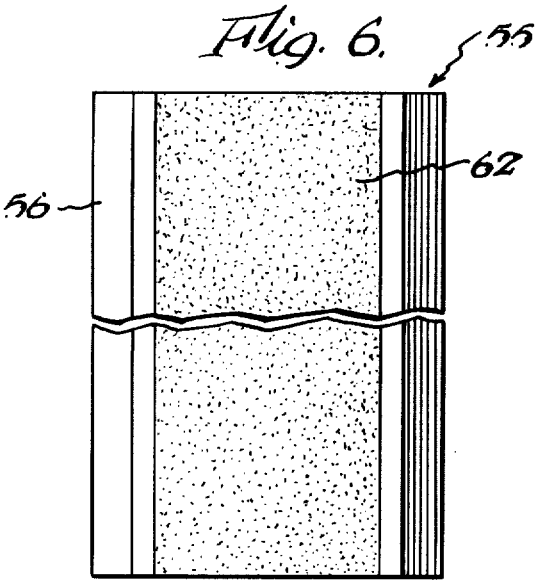
FIG. 6 is a top plan view of the member of FIG. 5.

In FIG. 2 shipping cask 21 is illustrated with internal framing walls 46 and 52 therein, with quadrant shaped end neutron absorbing plates 74, 75, 77 and 79, made similar in construction to the absorbers of FIGS. 5 and 7, and with sectors of heat conductive material 81, 83, 85 and 87 at ends thereof. As illustrated, thermally conductive end members 81, 83, 85 and 87 are of shorter heat transmitting thicknesses or lengths than members 37, 39, 41 and 43 of FIG. 1 because less heat needs to be transmitted axially than radially and the area of contact of the heat transmitting plates with the ambient air is not increased by thickening them. However, if desired, such plates or wedges and others shown in FIG. 4 may have the thickness thereof changed, as by increasing it. In FIG. 3 there are shown on shipping cask 21 thermally conductive portions and neutron absorbers at both ends. The conductive sectors are 89, 91, 93, 95, 97, 99, 101 and 103 and the neutron absorbing quadrants are 79, 77, 74 and 75. Also shown are the heat conducting members 113, 115, 117, 119, 121, 123, 125 and 217.

In FIG. 4 are shown the end heat conducting sectors 97, 99, 101, 103, 129, 131, 133 and 135. In FIG. 5 wall element or module 55, which may be employed interchangeably with other such walls, is shown. It comprises a base portion, shown as a solid metal base 56, and plasma sprayed radiation absorbing deposits 58 and 60 in undercuts therein, ground to smooth surfaces 62 and 64. Base 56 may also be hollow and may have boron carbide or other neutron or radiation absorber deposited thereon or may contain poison plates too, in addition to the surface coating of radiation absorber shown. Wall member 55 may be made by the method of Ser. No. 13,555, previously mentioned, and may have neutron absorber on only single wall faces.

Figure 8:
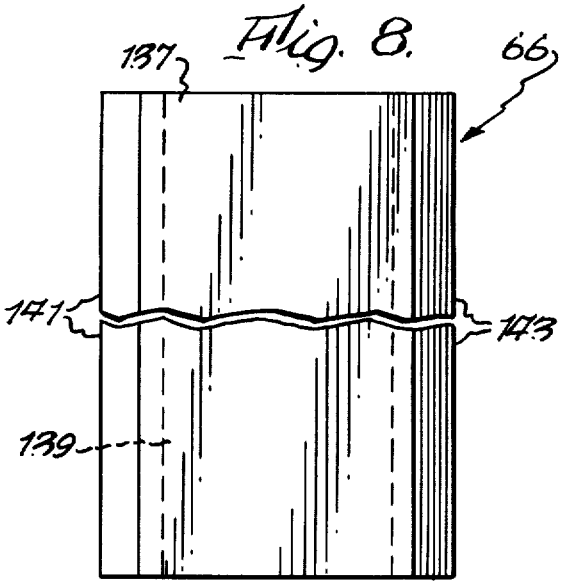
FIG. 8 is a top plan view of the member of FIG. 7.

In FIGS. 7 and 8 wall member 66 includes a casing portion 137 and an internal poison plate 139, preferably of boron carbide particles dispersed in a solid matrix of organic polymer, such as is described in one of the first six patent applications mentioned previously. It will be noted that the "sides" of wall 55 meet at 141 and 143 to form right angles, making such members readily fittable to other such members to form a plurality of tubular enclosures of square internal cross-section, in which fuel rods, etc. may be stored. However, other cross-sections, e.g., rectangular, are also useful and are within this invention.

Figure 11:
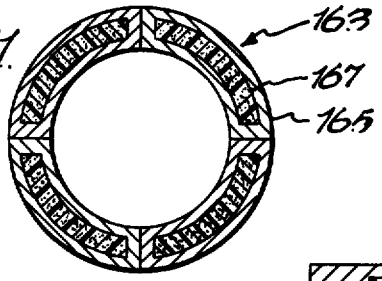
FIG. 11 is a vertical sectional view of a further modification of such a compartment.
Figure 9:
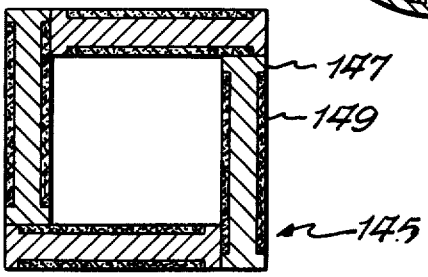
FIG. 9 is a vertical sectional view of a different type of compartment, showing walls of a different structure.
Figure 10:
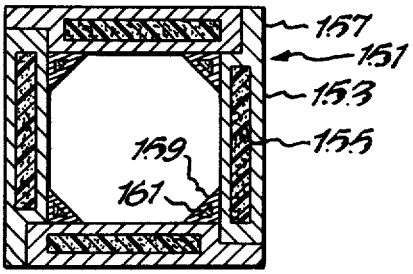
FIG. 10 is a vertical sectional view of another modification of such a compartment, with additional neutron shielding at the corners.

In FIG. 9 an alternative walled compartment structure 145 is illustrated with wall members 147 having "poison" deposits 149 contained therein. FIG. 10 shows another such compartment structure 151, with walled members 153, containing poison plates 155, overlapping similar members at ends thereof, as at 157. Also illustrated in such figure are additional corner strengthening members 159, each of which also contains a poison plate insert 161, so as to prevent "leakage" of neutrons through the compartment walls at corners thereof. In FIG. 11 a variation of the invention is shown with a circular compartment 163 being illustrated, the wall portions 165 of which contain curved poison "plate" members 167.

Figure 12:
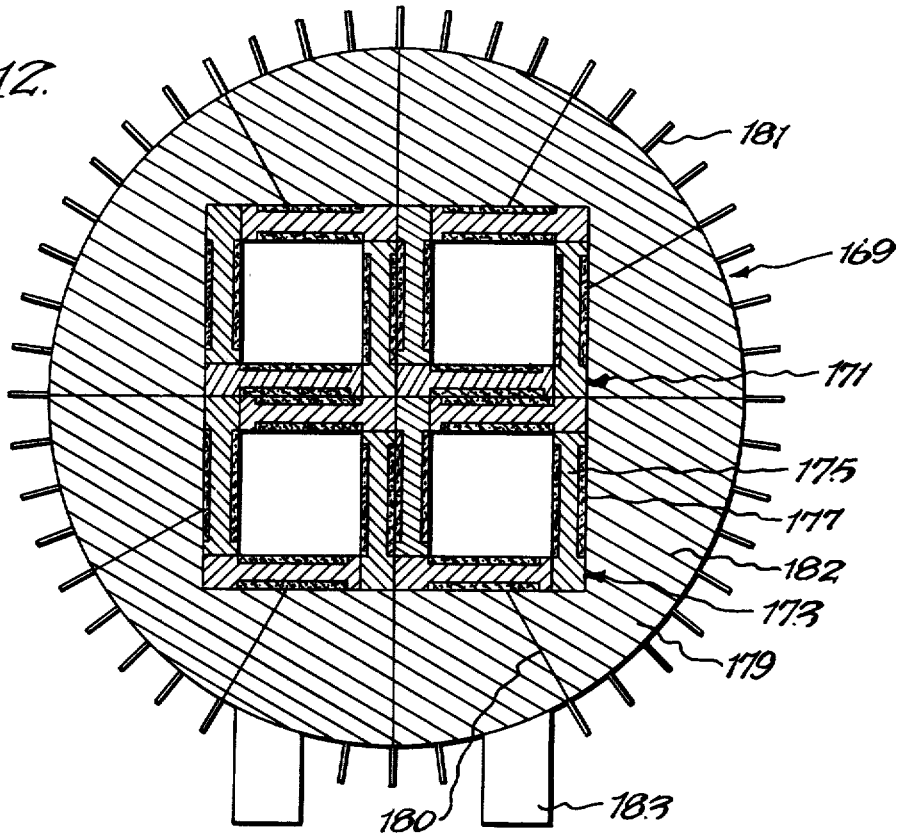
FIG. 12 is a vertical sectional view of a modified cask of this invention containing an assembly of neutron absorbing compartments but omitting interior framing members.

FIG. 12 depicts a shipping cask 169 having four compartments 171 for containing radioactive material, not shown, which compartments are made of modular wall units 173, each of which includes a base member 175 and an internal neutron absorbing deposit represented by numeral 177. The assembly of metal walled modular units, held together in close and tight heat conducting relationship with one another, is surrounded by heat conducting metal members, represented by numeral 179. Such units are in tight relationship with surrounding such units to facilitate heat conduction between them and have contacting surfaces 180 and 182 radially extending from the center of the cask, which is the center of the assembly of walled compartments for the radioactive material, e.g., spent nuclear fuel. Shipping cask 169 has radial fins 181 of conductive metal joined to members 179 to facilitate transfer of heat released by the radioactive material to the surroundings, e.g., air. Supports 183 hold the cask off the ground, truck bed, railroad car, concrete pad or other supporting surface, to facilitate external coolant circulation.

Figure 13:
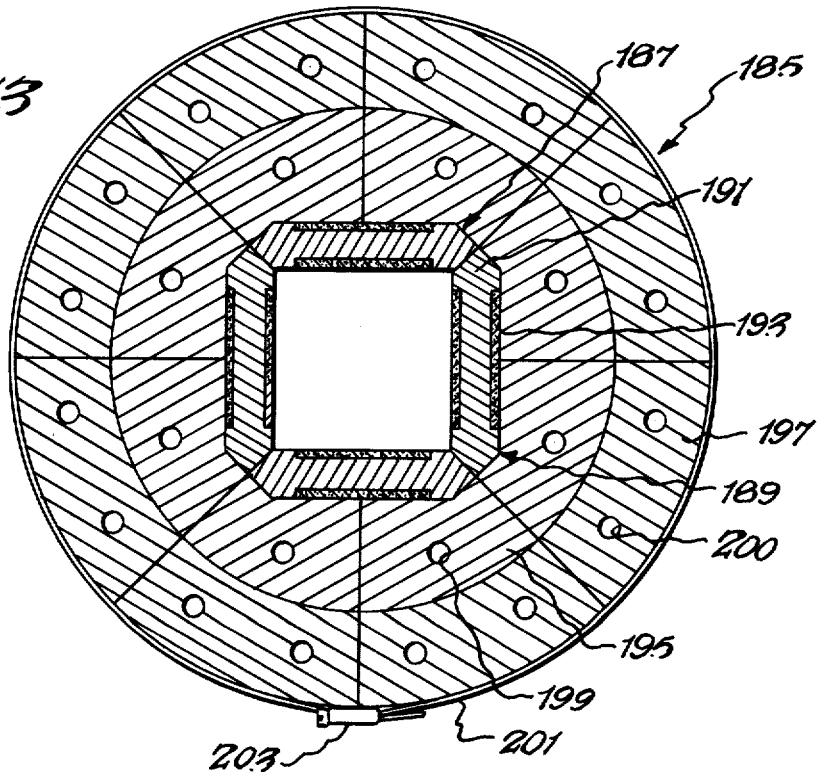
FIG. 13 is a vertical sectional view of another cask of this invention having only a single compartment.

In FIG. 13 shipping cask 185 is shown with only a single walled compartment 187 made up of four modular wall units 189, each of which contains a base portion 191 and a surface neutron absorbing deposit 193. About the compartment 187, in thermally conductive contact with the walls thereof, are lead radiation absorbing members 195 and about them are copper or other suitable conductive members 197. The lead is for gamma ray absorption and the copper is for thermal conduction and dissipation. The radial planar contacting surfaces between the sections are continuous, as illustrated. In some embodiments of the invention the lead and copper or other suitable thermal conductor may be present in a suitable alloy or other alloys of radiation absorber and thermal conductor may be employed. However such alloying often adversely affects thermal conductivity. Through the lead and copper members are passageways 199 and 200, respectively, for coolant, useful when extra cooling capacity may be needed. Coolant flow may be decreased or halted when the radioactivity diminishes sufficiently to warrant such action. The illustrated unit is held together tightly by surrounding strap(s) 201 and turnbuckle or other suitable tightening device 203, or may often be welded together.

As illustrated in the drawing, the present invention is applicable to the manufacture of shipping and storage casks and other such containers for radioactive material which may include one or more compartments for such material. Although compartments of square cross-section are favored, those of other cross-sectional shapes may also be utilized. Normally the compartments are tubular to accommodate nuclear fuel rods, either fresh or spent, but the invention is adaptable to the manufacture of other shapes of containers, e.g., cubic, spherical, toroidal, and for holding various other radioactive materials and products. While four sub-assemblies or modules are preferably utilized, with or without an internal framework (or one or two framing members) for each of the modules, other numbers of modules, e.g., 2–12, may also be utilized. Usually the number of compartments will be in the range of 4–32, but may be as great as 128, as when four sub-assemblies of 32 compartments each are employed. Preferably four sub-assemblies are present and thus, the number of compartments is divisible by four. The various portions of the different modules may be assembled permanently or removably, utilizing fastening techniques previously described, such as welding or cementing or the application of external or compacting pressures. The thermally conductive metal sheet, base envelope or casing which, together with the neutron absorbing material, forms a compartment wall, may include a neutron absorbing material, such as the plasma sprayed on boron carbide-metal mix of Ser. No. 13,555, mentioned previously, may have a poison plate inserted therein or may be of a construction of a combination of such devices. Although radial disposition of the joining surfaces of the thermally conductive outer members is highly preferable for most efficient conduction of heat away from the radioactive material, such surfaces may be otherwise located and shaped but it is desirable that they extend from the walls of the compartments to the exterior of the thermally conductive members, preferably in straight planes or smooth planar curves. To aid in conduction of heat it may be desirable to utilize a more highly conductive material inside the compartment wall, between the wall exterior and any contained neutron absorber. For example, a layer or plating of copper may be employed inside a stainless steel jacket. Also, compatible alloys may be utilized for corrosion resistance and heat conductivity, e.g., alloys of iron, chromium, nickel and copper.

It is preferred that as many as possible of the various modular units be identical, for simplicity and economics of manufacture and construction, but at least two such wall members of each compartment or sub-assembly are often identical and at least two thermally conductive members of each cask should be identical. Similarly, it is preferred that at least two sub-assemblies, each comprising at least one compartment or at least one thermally conductive member and preferably comprising at least one compartment and one conductive member, should be identical and interchangeable. When one unit appears to be the mirror image of another it may usually be employed to replace such other unit by reversing it, end for end. A cylindrical structure for the cask is highly preferred but other shapes, such as square, rectangular, oval, elliptical, octagonal, may also be employed. The individual compartments of the cask preferably utilize common walls but it is within the invention to assemble the compartments, each with its own walls, and then assemble the cask from them, so that some walls will be doubled. One may have the neutron absorber on only one face of the wall members (usually a thicker deposit is used) or on both and the deposits or poison plates may extend along a wall thereof to its ends or near its ends so as to close off the compartment and effectively absorb all emitted neutrons. Normally the cask will be tubular, preferably cylindrical and will be positioned or mounted horizontally, but it is within the invention to orient it otherwise, e.g., vertically. The compartments and conductive members may extend the length of the cask or may be made up of shorter members joined end to end to produce the desired cask length.

The preferred materials of construction of various components, sub-assemblies and parts of this invention have been mentioned but it should be understood that others may also be employed. For example, while copper is a highly preferred conductor, copper alloys, such as brass and bronze may also be used, as may be aluminum, magnesum-aluminum alloys, titanium, silver and other conductive metals (with thermal conductivities like the metals previously recited) and similar materials, even stainless steel, in suitable circumstances. Similarly, the compartment wall members may be of aluminum, copper, brass, bronze, stainless steel, silver, steel or of various other metals and alloys in particular circumstances where they will be sufficiently corrosion resistant and conductive. Such walls may be plated with other such materials or alloys or may be clad with them. While boron carbide in a form-retaining matrix such as a metal or alloy, e.g., copper, stainless steel, silver or aluminum, or a polymer, e.g., a phenolic polymer is a preferred neutron absorber other such neutron absorbers such as gadolinium, erbium and europium or any other neutron absorber of a capture cross-section greater than 200 Barns may also be employed. The boron carbide may be in particulate form or as metal borides, borates and equivalents. In some instances it may be desirable to include in the poison plates with boron carbide or in separate poison plates in the compartment walls materials for absorbing harmful radiation other than neutrons, e.g., lead, uranium oxide, polyethylene. Such materials may also be in powder form, mixed with a neutron absorber in similar form. Instead of holding the shipping cask parts together by bands and turnbuckles other means may be employed, e.g., welding, surrounding cylinders, rings and cage-like frames. Instead of relying on ambient air for cooling, air or other heat transfer fluid may be driven into contact with the cask exterior (or suitable interior locations) by mechanical means, such as fans and pumps. Thermostatic control devices may be included in the casks for turning on such mechanical means and/or for pumping cooling fluid through the cask interior when the temperature rises above an acceptable limit, e.g., 90° C.

The manufacture of the present casks is almost self-evident from the preceding description. Preferably it involves assembling together the wall members to form the walled longitudinal compartments for the radioactive material, making a sub-assembly of a plurality of such compartments and surrounding such sub-assembly at least on the side thereof intended to be on the outside in the final shipping cask, with a sub-assembly of a plurality of thermally conductive castings for conducting heat away from the compartments, or with separate such conductors. In making this assembly the interior walls of some of the compartments may be part of the framework of the interior framework of the shipping cask so that a quadrant, sub-assembly or module comprising compartment walls and heat conductive members may be produced, which may then be assembled with other such modules to form the final cask. The framework may include neutron and/or other radiation absorbers in forms like those previously described. In the absence of a framework the modular sub-assembly described may also be made, with neutron absorbing walls substituted for the framing part, and such sub-assembly may subsequently be combined with other such sub-assemblies to form the shipping cask, usually with the cask being held together by external means, such as strapping, welding or other such means previously described.

To employ the present invention is relatively simple. The shipping cask, in horizontal, vertical or inclined position, with one end opened, is filled with nuclear reactor fuel rods or other radioactive material, the end coverings are installed and bolted or otherwise fastened in place and the cask is set in desired, normally horizontal, position for transportation or storage. With materials of construction such as those previously described and with the mentioned neutron absorber being utilized, designed for absorption of all harmful neutrons emitted from the radioactive material (and preferably with means for absorbing any other harmful radiation emitted), safe storage is possible for extended periods of time, up to 20 years and more.

The various advantages of the present construction are clear from the previous description but will be summarized briefly. The modular construction of the various parts, including compartments, walls, sub-assemblies of compartments, sub-assemblies of heat conducting members and sub-assemblies of both compartments and heat conducting members, with or without additional framing, allows flexibility in manufacturing and assembling procedures and facilitates repair and replacement of parts, should that be needed. It also facilitates flexibility of design, it being possible to stock a number of different types of wall assemblies, each with a different neutron absorbing capability due to containing different absorber deposits or plates (or different strength absorbers of other radiation than neutrons) or containing no such absorbers. These may be assembled with other walls for best and most efficient use thereof. Different types of heat conducting members may also be employed in modules, so that longer or shorter heat paths may be utilized, resulting in larger or smaller surface areas of the shipping cask. In short, modular construction of the shipping casks and similar containers for radioactive materials represents a significant advance in the art, making the manufacture, maintenance and repair of such products easier, cheaper and better.

The modular, segmented cask structure, with as many contact surfaces of the compartment walls and thermal conductors as feasible being radial or otherwise parallel (not transverse) to desired outward heat flow direction facilitates heat dissipation. Thus, joints and seams and any other discontinuities and thermal barrier surfaces should be parallel to heat flow direction (usually radial). The plasma deposited radiation absorber in a matrix of conductive metal also helps to dissipate heat from the nuclear fuel or other radioactive substance contained. By suitable design of placements of the radiation absorbers, e.g., by utilizing supplemental absorbers at compartment corners, leakage of radiation may be prevented.

The invention has been described with respect to various embodiments and illustrations thereof but is not to be limited to these because it is clear that one of skill in the art, with the present specification and drawing before him, will be able to utilize substitutes and equivalents without departing from the invention.

What is claimed is:

1. A cylindrical cask for nuclear reactor fuel which comprises a plurality of longitudinally extending walled internal compartments for containing such material and for absorbing radiation emitted by such material, at least some of which compartments are of four interchangeable wall members of the same shape that are fitted together at sides thereof to make such compartments of square cross-section, which wall members have bodies of a material selected from the group consisting of stainless steel, copper, aluminum and silver, and have as inserts in such bodies neutron absorbing plates of boron carbide particles in a matrix of phenolic polymer to bar movements of neutrons emitted from the nuclear fuel, and a plurality of thermally conductive members about such walled compartments to carry heat away from the nuclear fuel and from compartments containing such fuel, which members are in thermal contact with the compartment walls and in thermal contact with each other along surfaces thereof, said surfaces extending radially from such compartments to external surfaces of such thermally conductive members, which external surfaces form an outer cylindrical wall of the cask, with such thermally conductive members being of a material selected from the group consisting of copper, aluminum and silver, and with at least some of them being of the same shape as other such members, and radiation absorbing means and thermally conductive covers therefor at ends of the cask for preventing radiation emissions at such ends and for conducting heat away from the nuclear fuel at such ends of the cask.

2. A shipping cask according to claim 1 wherein each end thereof includes at least one plate of metal with boron carbide particles incorporated on a surface thereof by plasma spraying with metal particles to serve as a neutron absorbing means and a plate of copper or a plurality of copper wedges, in thermal contact with each other and with the wall members of the compartment, which wall members are of stainless steel.

3. A cylindrical cask for nuclear reactor fuel which comprises a plurality of longitudinally extending walled internal compartments for containing such fuel and for absorbing radiation emitted by such fuel, at least some of which compartments are of four interchangeable wall members of the same shape that are fitted together at sides thereof to make such compartments of square cross-section, which wall members have bodies of a material selected from the group consisting of stainless steel, copper, aluminum and silver, and have as inserts in such bodies neutron absorbing plates of boron carbide particles in a matrix of phenolic polymer to bar movement of neutrons emitted from the nuclear fuel, and a plurality of thermally conductive members about such walled compartments to carry heat away from the nuclear fuel and from the compartments containing such fuel, which members are in thermal contact with the compartment walls and in thermal contact with each other along surfaces thereof, said surfaces extending radially from such compartments to external surfaces of such thermally conductive members, which external surfaces form an outer cylindrical wall of the cask, with such thermally conductive members being of a material selected from the group consisting of copper, aluminum and silver, and with at least some of them being of the same shape as other such members, and radiation absorbing means and thermally conductive covers therefor at ends of the cask for preventing radiation emissions at such ends and for conducting heat away from the nuclear fuel at such ends of the cask.

4. A shipping cask according to claim 3 wherein each end thereof includes at least one plate of boron carbide particles in a matrix of phenolic polymer as a neutron absorbing means and a plate of copper or a plurality of copper wedges, in thermal contact with each other and with the wall members of the compartment, which wall members are of stainless steel.

5. A shipping or storage cask for nuclear reactor fuel which comprises an assembly of a plurality of longitudinally extending walled compartments for containing such fuel, which compartments include wall members to absorb radiation emitted by the fuel, said compartments each being of a plurality of wall members fitted together, with at least two such members per compartment being of identical construction so that they are interchangeable before assembly, said wall members each including a body of thermally conductive metal and a deposit on at least one surface of such a member of boron carbide plasma sprayed thereon, with the assembly of compartments including a plurality of common wall members so that single wall members serve as walls for a plurality of compartments, and a plurality of thermally conductive members about the assembly of walled compartments, with surfaces of such conductive members in thermal contact with outer walls of the assembled compartments and with adjacent such thermally conductive members along surfaces thereof extending substantially radially from the outer walls of such assembled compartments to external surfaces of such thermally conductive members, so that neutrons emitted from the nuclear fuel are barred from emission from the cask and heat released by the nuclear fuel is readily conducted to the exterior of such cask.

6. A cask according to claim 5 wherein each compartment is of a plurality of wall members of the same shape, fitted together at sides thereof and assisting in forming a compartment of square internal cross-section and at least some of the thermally conductive members are of the same shape as other such members and form a cask having a cylindrical outer wall.

7. A cask according to claim 6 wherein the wall members are of a material selected from the group consisting of stainless steel, copper, aluminum and silver, the neutron absorbing deposits are of boron carbide and a metal selected from the group consisting of stainless steel, copper, aluminum and silver plasma sprayed together, the thermally conductive members are of copper, the surfaces thereof in thermal contact with each other extend radially from the center of the assembly of compartments to the outer cylindrical wall of the shipping cask and the ends of the cask include neutron absorbing means for preventing neutron emissions at such ends and include thermally conductive material to conduct heat away from the radioactive nuclear fuel of the assembly of compartments and from the neutron absorbing means to the ends of the shipping cask.

8. A shipping cask according to claim 7 wherein each end thereof includes at least one plate of a conductive metal with boron carbide plasma sprayed thereon as a neutron absorbing means and a plate of copper or a plurality of copper wedges, in thermal contact with each other and with the casing walls of the compartment.

9. A shipping or storage cask for nuclear reactor fuel which comprises an assembly of a plurality of longitudinally extending walled compartments of square internal cross-section for containing such fuel, which compartments include wall members to absorb radiation emitted by the fuel, said compartments each being of a plurality of wall members fitted together, with at least two such members per compartment being of identical construction so that they are interchangeable before assembly, said wall members each including a casing of a material selected from the group consisting of stainless steel, copper, aluminum and silver, and a neutron absorbing plate of boron carbide particles in a matrix of phenolic polymer, with the assembly of compartments including a plurality of common wall members so that single wall members serve as walls for a plurality of compartments, a plurality of thermally conductive members about the assembly of walled compartments, with surfaces of such conductive members in thermal contact with outer walls of the assembled compartments and with adjacent such thermally conductive members along surfaces thereof extending radially from the outer walls of such assembled compartments to external surfaces of such thermally conductive members, and ends of the cask including neutron absorbing means for preventing neutron emissions at such ends and thermally conductive material to conduct heat away from the radioactive nuclear fuel of the assembly of compartments and from the neutron absorbing means to such ends.

10. A shipping cask according to claim 9 wherein each end thereof includes at least one plate of boron carbide particles in a matrix of phenolic polymer as a neutron absorbing means and a plate of copper or a plurality of copper wedges, in thermal contact with each other and with the casing walls of the compartment.

11. A longitudinally extending cask for nuclear reactor fuel which comprises an assembly of a plurality of walled compartments for containing such fuel and a plurality of thermally conductive members in a plurality of sub-assemblies of essentially the same shape, fitted together to form the assembly of compartments, which are substantially square in cross-section, the compartments each having for a wall thereof a thermally conductive metal wall member wherein the metal is selected from the group consisting of stainless steel, copper and aluminum, with a plasma sprayed mix of boron carbide and a conductive metal selected from the group consisting of stainless steel, copper and aluminum plasma sprayed onto the wall member of the same metal, with at least two wall members of at least one such compartment being of the same shape, the sub-assemblies of compartments each including a plurality of common members so that single members serve as walls for a plurality of compartments, and with the thermally conductive members of each sub-assembly being selected from the group consisting of copper and aluminum and being in thermal contact with each other along surfaces extending substantially radially from outer walls of the assembled compartments, and with at least one such thermally conductive member including boron carbide as a neutron absorber on an interior portion thereof, which interior portion forms a compartment wall member, and ends of the cask shielded by neutron absorbing means in conductive end members and including thermally conductive material to conduct heat away from the nuclear fuel and from the conductive end members to the ends of the cask, so that escape from the cask of neutrons emitted by the nuclear reactor fuel is prevented.

12. A longitudinally extending cask for nuclear reactor fuel which comprises an assembly of a plurality of walled compartments for containing such fuel and a plurality of thermally conductive members in a plurality of sub-assemblies of essentially the same shape, fitted together to form the assembly of compartments, which are substantially square in cross-section, the compartments each having for a wall thereof a thermally conductive metal wall member wherein the metal is selected from the group consisting of stainless steel, copper and aluminum, containing a neutron absorbing insert therein which is a plate of boron carbide particles in a matrix of phenolic polymer, with at least two wall members of at least one such compartment being of the same shape, the sub-assemblies of compartments each including a plurality of common members so that single members serve as walls for a plurality of compartments, and with the thermally conductive members of each sub-assembly being selected from the group consisting of copper and aluminum, and being in thermal contact with each other along surfaces extending substantially radially from outer walls of the assembled compartments, and with at least one such thermally conductive member including boron carbide as a neutron absorber on an interior portion thereof, which interior portion forms a compartment wall member, and ends of the cask shielded by neutron absorbing means in conductive end casings and including thermally conductive material to conduct heat away from the nuclear fuel and from the conductive end casings to the ends of the cask, so that escape from the cask of neutrons emitted by the nuclear reactor fuel is prevented.

13. A method of preventing neutron release from neutron emitting radioactive material which comprises surrounding such material with a longitudinally extending thermally conductive stainless steel casing for it containing as a neutron absorber boron carbide particles in a matrix of phenolic polymer, which casing forms a compartment about the neutron emitting material, and conducting heat generated by decay thereof through the casing and through copper for a distance at least equal to the distance across the interior of the compartment and along an uninterrupted path through the copper, the casing being made up of a plurality of separate parts containing the neutron absorbing material and the copper being in several pieces, adjoining each other along essentially radially extending surfaces from the compartment casing containing the radioactive material to the exterior of the copper, which exterior is of cylindrical shape.

14. A method of preventing neutron release from neutron emitting radioactive material which comprises surrounding such material with a longitudinally extending thermally conductive copper casing for it containing as a neutron absorber boron carbide particles in a matrix of phenolic polymer, which casing forms a compartment about the neutron emitting material, and conducting heat generated by decay thereof through the casing and through copper for a distance at least equal to the distance across the interior of the compartment and along an uninterrupted path through the copper, the casing being made up of a plurality of separate parts containing the neutron absorbing material and the copper being in several pieces, adjoining each other along essentially radially extending surfaces from the compartment casing containing the radioactive material to the exterior of the copper, which exterior is of cylindrical shape.

15. A method of preventing neutron release from neutron emitting radioactive material which comprises surrounding such material with a longitudinally extending thermally conductive stainless steel casing for it containing as a neutron absorber boron carbide in a copper matrix plasma sprayed thereon, which casing forms a compartment about the neutron emitting material, and conducting heat generated by decay thereof through the casing and through copper for a distance at least equal to the distance across the interior of the compartment and along an uninterrupted path through the copper, the casing being made up of a plurality of separate parts containing the neutron absorbing material and the copper being in several pieces, adjoining each other along essentially radially extending surfaces from the compartment casing containing the radioactive material to the exterior of the copper, which exterior is of cylindrical shape.

16. A method of preventing neutron release from neutron emitting radioactive material which comprises surrounding such material with a longitudinally extending thermally conductive stainless steel casing for it containing as a neutron absorber boron carbide in a stainless steel matrix plasma sprayed thereon, which casing forms a compartment about the neutron emitting material, and conducting heat generated by decay thereof through the casing and through copper for a distance at least equal to the distance across the interior of the compartment and along an uninterrupted path through the copper, the casing being made up of a plurality of separate parts containing the neutron absorbing material and the copper being in several pieces, adjoining each other along essentially radially extending surfaces from the compartment casing containing the radioactive material to the exterior of the copper, which exterior is of cylindrical shape.

17. A method of preventing neutron release from neutron emitting radioactive material which comprises surrounding such material with a longitudinally extending thermally conductive copper casing for it containing as a neutron absorber boron carbide in a stainless steel matrix plasma sprayed thereon, which casing forms a compartment about the neutron emitting material, and conducting heat generated by decay thereof through the casing and through copper for a distance at least equal to the distance across the interior of the compartment and along an uninterrupted path through the copper, the casing being made up of a plurality of separate parts containing the neutron absorbing material and the copper being in several pieces, adjoining each other along essentially radially extending surfaces from the compartment casing containing the radioactive material to the exterior of the copper, which exterior is of cylindrical shape.

18. A method of preventing neutron release from neutron emitting radioactive material which comprises surrounding such material with a longitudinally extending thermally conductive copper casing for it containing as a neutron absorber boron carbide in a copper matrix plasma sprayed thereon, which casing forms a compartment about the neutron emitting material, and conducting heat generated by decay thereof through the casing and through copper for a distance at least equal to the distance across the interior of the compartment and along an uninterrupted path through the copper, the casing being made up of a plurality of separate parts containing the neutron absorbing material and the copper being in several pieces, adjoining each other along essentially radially extending surfaces from the compartment casing containing the radioactive material to the exterior of the copper, which exterior is of cylindrical shape.

* * * * *